US005263086A

United States Patent [19]

Yamazaki

[11] Patent Number: 5,263,086

[45] Date of Patent: Nov. 16, 1993

[54] AUDIO ACCESSORY CIRCUIT

[75] Inventor: Daisuke Yamazaki, Kanagawa, Japan

[73] Assignee: Sony Corporation, Tokyo, Japan

[21] Appl. No.: 708,232

[22] Filed: May 31, 1991

[30] Foreign Application Priority Data

May 31, 1990 [JP] Japan ..... 2-139641

[51] Int. Cl.[5] ..... H04S 1/00

[52] U.S. Cl. ..... 381/1

[58] Field of Search ..... 381/1, 28

[56] References Cited

U.S. PATENT DOCUMENTS 4,355,203 10/1982 Cohen ..... 381/1

4,394,536 7/1983 Shima et al. ..... 381/1

*Primary Examiner*—Forester W. Isen

*Attorney, Agent, or Firm*—Hill, Steadman & Simpson

[57] ABSTRACT

The gain of the frequency components in a given band of the difference signal between stereophonic input L and R channel signals is desirably changed and is added to the input L and R channel signals and the gains of the components of the difference signal in high and low frequency bands are desirably changed so that massive stereophonic reproduced sound having presence can be obtained by a simple and inexpensive structure.

6 Claims, 2 Drawing Sheets

AUDIO ACCESSORY CIRCUIT

BACKGROUND OF THE INVENTION

The present invention relates to an audio accessory circuit for providing a stereophonic reproduced sound with a presence sensation.

Input stereophonic signals may have conventionally been subjected to so-called surround processing for providing a stereophonic reproduced sound with a presence. The surround processing is usually performed by obtaining the difference between, for example, stereophonic L (left) and R (right) channel signals and changing the phase of the obtained difference signal.

An audio accessory apparatus for performing the surround processing comprising a subtracting circuit for obtaining the difference signal components from stereophonic input signals, a delay circuit for delaying the output signal from the subtracting circuit by a desired delay time and a level control circuit for amplifying or attenuating the output signal from the delay circuit so that the output of the level control circuit is added to said stereophonic input signals for outputting the added signals is disclosed in, for example, Japanese Unexamined Utility Model publication No. 61-93100.

However, a number of coils and capacitors are usually necessary for a delay element which forms a delay circuit used for the audio accessory apparatus disclosed in the above-mentioned publication. Accordingly, the structure of the whole of the apparatus becomes complicated and expensive. The audio accessory apparatus disclosed in the above-mentioned publication has a four-channel type output. This also causes the system to become complicated and expensive.

Recently, miniaturization of stereophonic reproducing apparatus has been strongly demanded. Accordingly, efforts for forming the audio accessory circuit for performing the surround processing of ICs have been made. The audio accessory circuit made of ICs are formed in such a manner that input stereophonic signals are passed through band pass filters having different pass bands and the gain of each band pass filter is controlled in response to the detected level of the component of each resultant frequency band.

However, the audio accessory circuit made of ICs requires a number of external parts, resulting in a complicated structure.

Therefore, the present invention was proposed under the above-mentioned circumstances. It is an object of the present invention to provide an audio accessory circuit having a simple and inexpensive structure in which the number of external parts can be reduced even if the circuit is made of ICs.

The audio accessory circuit of the present invention was proposed to accomplish the above-mentioned object and comprises subtracting means for outputting the difference signal between stereophonic input L and R channel signals variable gain band pass means for passing only frequency components of a given band from the output of said subtracting means and for desirably changing the gain of the frequency components to be passed; and adding means for adding the output of the variable gain band pass means to the signals of the input L and R channels.

The variable gain band pass means passes the components in high and low frequency bands and desiredly changes the gains of these frequency components.

In accordance with the present invention, reproduced sound is provided with presence by changing the gain of the components in a given frequency band, in particular, the components in a high frequency band over a wide range to emphasize the sound in the high frequency band and the reproduced sound is provided with massive sensation by changing the gain of the components in a low frequency band over a wide range to emphasize the sound in the low frequency band.

DESCRIPTION OF THE PREFERRED EMBODIMENTS

Now, preferred embodiments of the present invention will now be described with reference to drawings.

Figure 1:
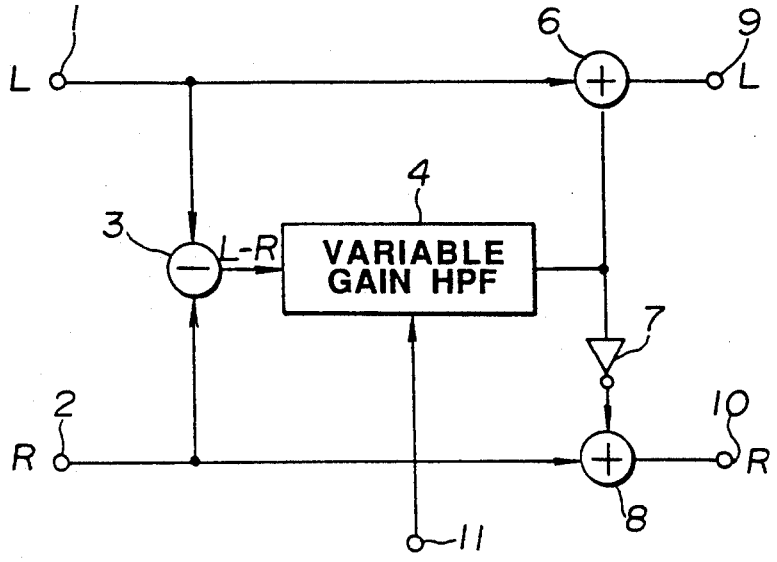
FIG. 1 is a schematic block diagram showing a first embodiment of an audio accessory circuit of the present invention.
Figure 2:
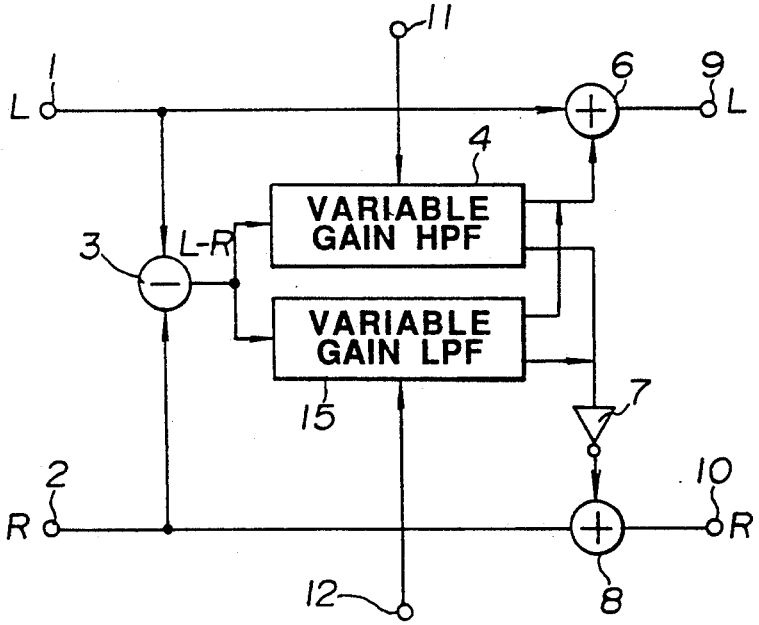
FIG. 2 is a schematic block diagram showing a second embodiment of an audio accessory circuit of the present invention.

Referring now to FIGS. 1 and 2, there are shown schematic block diagrams of first and second embodiments of audio accessory circuits of the present invention.

The audio accessory circuit of the first embodiment as shown in FIG. 1 comprises a subtracter 3 for outputting a difference signal (for example, L−R) between stereophonic input L and R channels, a variable gain high pass filter 4 which is a variable gain band pass means for passing only frequency components in a given band, for example only high frequency band components from the output of the subtracter 3 and for desirably changing the gain of the frequency component and adders 6 and 8 for adding the output of the variable gain high pass filter 4 to the signals on the input L and R channels, respectively.

The second embodiment of the audio accessory circuit is substantially identical with the first embodiment except that the variable gain band pass means of the audio accessory of FIG. 2 comprises a variable gain high and low pass filters 4 and 15 for passing the components in the high and low frequency bands, respectively and for desirably changing the gains of respective frequency components. In the circuit of FIG. 2, like components of FIGS. 1 through 2 are designated by like reference numerals.

In the circuit of the first embodiment as shown in FIG. 1, stereophonic input L and R channel signals are supplied to input terminals 1 and 2, respectively. A signal representative of the difference between the input L and R channel signals (for example L−R) is obtained by supplying the subtracter 3 with these signals. The difference signal is fed to the variable gain high pass filter 4. The variable gain high pass filter 4 passes only the difference signal in a high frequency band not higher than 2 kHz and can change the gain of the difference signal (the gain of the signal having components in a high frequency band) in response to a control signal from a terminal 11 so that, for example, the gain increases. The control signal is supplied in the form of a direct current value obtained by, for example, a variable resistor. The output of the variable gain high pass filter 4 is fed to the adders 6 and 8. At this time, the input L and R channel signals are supplied to the adders 6 and 8, respectively. In these adders 6 and 8, the output signals of the variable gain high pass filter 4 are added with the input L and R channel signals (at 1:1), respectively when they are in phase. The signal which is fed to the adder 8 is reversed by an inverter and is fed to the adder 8 as a subtracting signal. That is, the inverter 7 is provided for the following reasons. If the output of the variable gain high pass filter 4 is applied to the adder 6 in case where the output (difference signal) of the subtracter 3 is L−R, the output of the adder 6 includes the L channel signal having emphasized high frequency components while if the output of the variable gain high pass filter 4 is applied to the adder 8 without being inverted, the output of the adder 8 includes the R channel signal having deemphasized high frequency component. Accordingly, the R channel signal having emphasized high frequency component can be obtained from the adder 8 by applying to the adder 8 a subtracting signal obtained by reversing the output of the variable gain high pass filter 4 and the adder 6 if, for example, subtraction R−L is performed in the subtracter 3.

As mentioned above, the circuit of the first embodiment as shown in FIG. 1 can be realized by simple, small size and inexpensive components such as subtracter, variable gain high pass filter, adder and inverter. Stereophonic signals having emphasized high frequency are obtained from the output terminals 9 and 10 by adding the difference signal in which the gain of the high frequency band component is increased to the input L and R channel signals. In other words, the sound can be normally provided with a presence sensation by emphasizing the high frequency range of the stereophonic reproduced sound. Therefore, stereophonic sound having a presence sensation can be obtained by reproducing the stereophonic signals obtained by the audio accessory circuit of the first embodiment.

Figure 3:
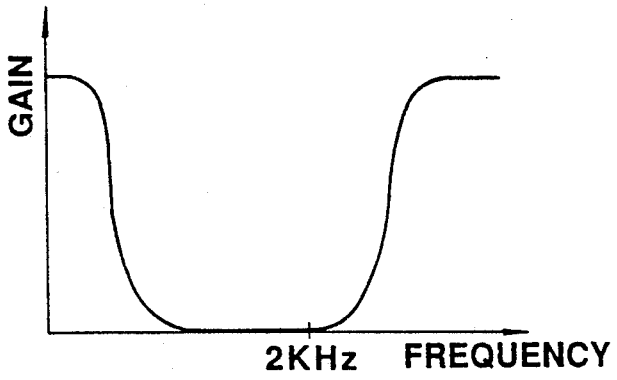
FIG. 3 is a graph showing the increase in gain of the components in low and high frequency band in the circuit of the second embodiment.

In the circuit of the second embodiment of FIG. 2, the components in the low frequency band as well as the high frequency band can be emphasized by adding to the circuit of the first embodiment a variable gain low pass filter 15 which is capable of passing the low frequency band and changing the gain of the difference signal from the subtracter 3 over a wide range in response to a control signal (for example, d.c. current value) from the terminal 12. That is, low and high frequency band signals are passed through and emphasized by the variable gain low and high pass filters 15 and 4, respectively as shown in FIG. 3. The outputs of the variable gain low and high pass filters 15 and 4 are applied to the adders 6 and 8. Balance of sounds can be kept by providing the filters 15 and 4 with a given constant and simultaneously variably controlling the filters 15 and 4 when the variable gain low and high pass filters 15 and 4 in response to a control signal.

From the foregoing, the reproduced sounds of the stereophonic signals obtained from the output terminals 9 and 10 of the circuit of the second embodiment have high presence and fidelity. Massive sound is reproduced even by so-called low end speakers and headphones which is adverse in low frequency reproducing characteristics since the characteristics in low frequency band is compensated for.

Figure 4:
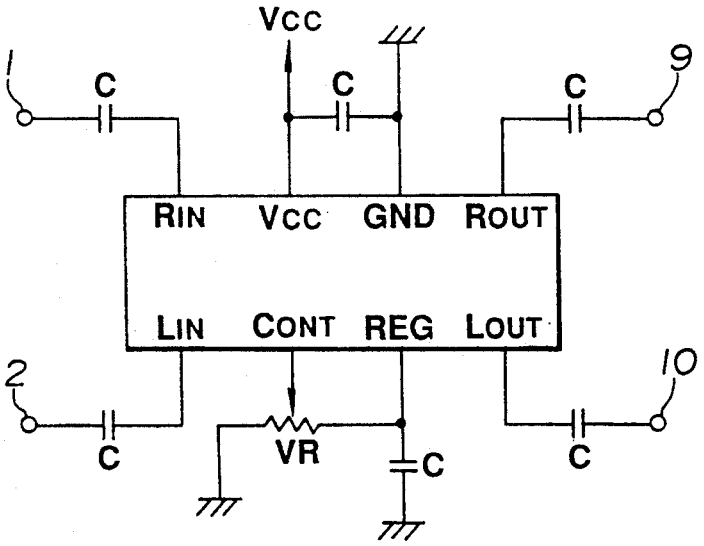
FIG. 4 is a circuit diagram showing a circuit of the first or second embodiment is made of an IC chip.

The circuits of the first and second embodiments can be integrated into a so-called DIP (Dual Inline Package) IC having eight pins which is shown, for example, in FIG. 4. In the IC of FIG. 4, parts are only six capacitors C and one variable resistor VR. The number of the external parts is very small. A d.c. current from the variable resistor VR is a control signal to the variable gain high and low pass filters 4 and/or 15.

In the audio accessory circuit of the present invention, the gain of the frequency components in a given band of the difference signal between stereophonic input L and R channel signals is desirably changed and is added to the input L and R channel signals and the gains of the components of the difference signal in high and low frequency bands are desiredly changed so that massive stereophonic reproduced sound having presence can be obtained by a simple and inexpensive structure. The audio accessory circuit can be operated by a small number of external parts even if it is made of an IC chip.

What is claimed is:

1. An audio accessory circuit, consisting essentially of subtracting means for outputting the difference signal between stereophonic input L and R channel signals;

variable gain high pass filter means for passing only frequency components of a given band from the output of said subtracting means and for desirably changing the gain of the frequency components to be passed; and adding means for adding the output of the variable gain high pass filter means to the signals of the input L and R channels.

2. The audio accessory circuit of claim 1 wherein the high pass filter means has a cut-off frequency of 2 kHz.

3. An audio accessory circuit comprising:

subtracting means for outputting the difference signal between stereophonic input L and R channel signals;

variable gain high pass filter means for passing only frequency components of a given band from the output of said subtracting means and for desirably changing the gain of the frequency components to be passed; and adding means for adding the output of the variable gain high pass filter means to the signals of the input L and R channels wherein said variable gain high pass filter means is connected in parallel to a variable gain low pass filter means for passing the components in high and low frequency bands, respectively, and desirably changing the gain of the frequency components.

4. An audio accessory circuit as defined in claim 3 in which the signal of one channel is subtracted from the signal of the other channel and the output of said variable gain high pass filter is added to the other channel signal and is added to the one channel signal via an inverter.

5. The audio accessory circuit of claim 3 wherein the high pass filter means and the low pass filter means can be independently controlled.

6. The audio accessory circuit of claim 3 wherein the high pass filter means has a cut-off frequency of 2 kHz.

* * * * *